US006131291A

United States Patent [19]

Mock

[11] Patent Number: 6,131,291

[45] Date of Patent: Oct. 17, 2000

[54] ADJUSTABLE, QUICK DISCONNECT PIVOT FASTENER

[75] Inventor: Mel Corrie Mock, Rocky Ford, Ga.

[73] Assignee: Cooper Industries, Inc., Houston, Tex.

[21] Appl. No.: 09/148,781

[22] Filed: Sep. 4, 1998

[51] Int. Cl.[7] ..... B26B 13/28

[52] U.S. Cl. ..... 30/266; 30/270; 411/259; 411/337

[58] Field of Search ..... 30/266, 267, 270, 30/254, 341; 411/190, 191, 259, 337

[56] References Cited

U.S. PATENT DOCUMENTS

| | | | |
|---|---|---|---|
| 725,718 | 4/1903 | Johns et al. | 30/266 |
| 1,079,997 | 12/1913 | Wernimonet | 30/266 |
| 2,436,560 | 2/1948 | Feather | 30/266 |
| 2,511,187 | 6/1950 | Weidauer | 30/266 |
| 2,741,843 | 4/1956 | Sejman et al. | 30/266 |
| 3,289,296 | 12/1966 | Hedstrom et al. | 30/267 |
| 3,331,132 | 7/1967 | Miles et al. | 30/266 |
| 3,672,053 | 6/1972 | Wiss | 30/267 |
| 4,473,947 | 10/1984 | Ishida et al. | 30/267 |
| 5,243,762 | 9/1993 | Orthey | 30/267 |
| 5,325,592 | 7/1994 | Lindén | 30/254 |

FOREIGN PATENT DOCUMENTS

| | | | |
|---|---|---|---|
| 1034454 | 6/1966 | United Kingdom | 30/267 |

*Primary Examiner*—Hwei-Siu Payer
*Attorney, Agent, or Firm*—Coats & Bennett, P.L.L.C.

[57] ABSTRACT

An adjustable and releasable fastener for a pivoting hand tool includes a first bushing and a second bushing which are press fit in respective tool elements, the second bushing extending into a hole in the first bushing to form a pivot bearing. The first bushing includes a cap with a recess having a slotted opening connecting to the hole in the first bushing. A bolt is extends through the first and second bushings, with a bolt head disposed in the recess. A nut is fastened to a threaded end on the second bushing side. The nut can be tightened or loosened to adjust the tension on the bolt. The bolt head is shaped to allow it to pass through the slotted opening in the first bushing when the tool elements are pivoted beyond an operating range, permitting quick release of the tool elements.

19 Claims, 3 Drawing Sheets

ADJUSTABLE, QUICK DISCONNECT PIVOT FASTENER

BACKGROUND AND SUMMARY

The pivot joint in hand tools receives large shear loads as force is applied to the workpiece during use. In cutting tools, for example, scissors, shears, and snips, the pivot joints are also subject to axial loads tending to separate the cutting blades as the blades are forced through the work material. The ride of the blades, that is, the force holding the blades against one another, is typically set at the factory during assembly of the tool. This presents certain disadvantages, however. The factory set ride is not generally suitable for every user of the tool. In addition, wear on the blades or the thickness of the material being cut may require user adjustment of the ride. Further, for cleaning or sharpening, the user will need to disassemble the blades. Conventional fastener arrangements usually require the use of a screwdriver and/or pliers, for adjustment and disassembly, which is cumbersome and time consuming.

The invention provides a fastener for pivoting hand tools, in particular for cutting tools, that allows simple adjustment of the fastening tension, so that the user can easily adjust the ride.

The invention also provides a fastener that allows quick release of the tool elements for disassembly, without the use of tools.

The fastener according to the invention provides a pivot bearing that improves on convention pivot bearings, usually the bolt connector itself, for more reliable and smoother operation of the tool.

According to the invention, a pivot fastener includes bushings that are press fit into mounting holes in the pivoting tool elements. The bushings and the mounting holes are shaped to resist relative rotation, for example, by keying the mounting holes and forming mating flats on the bushings, or by using a square hole and square-profiled bushing. A bolt inserted through holes in the bushings and secured by a thumb nut fastens the arrangement together.

According to the invention, a first bushing has a relatively wide hole that accepts the shank of the second bushing. The contacting surfaces of the bushings provides a pivot bearing when the tool elements are pivoted.

According to another aspect of the invention, a first bushing has a cap with a recess. A slotted opening in the recess connects to the through hole. The bolt is inserted through the through hole with the head disposed in the recess. The bottom of the recess includes shoulders that define the slotted opening and provide bearing surfaces for the bolt head. Within the normal pivoting range of the tool elements, the bolt head bears on the shoulders to keep the tool elements fastened. By pivoting the tool elements past the normal range, the bolt head, which is shaped to correspond to the slotted opening, is aligned with the opening and can pass through the first bushing. The tool elements are thereby released for disassembling the tool.

According to another aspect of the invention, the second bushing includes a flange that bears on the second tool element. The bolt extends through the second bushing, and a nut is screwed onto the bolt, applying tension across the fastener. The nut can be turned to adjust the tension, and accordingly, the ride on the blades. The nut is provided with ribs or wings to allow hand turning.

BRIEF DESCRIPTION OF THE DRAWINGS

The invention will be better understood through the following description read in conjunction with the appended drawings, wherein.

DETAILED DESCRIPTION

Figure 1:
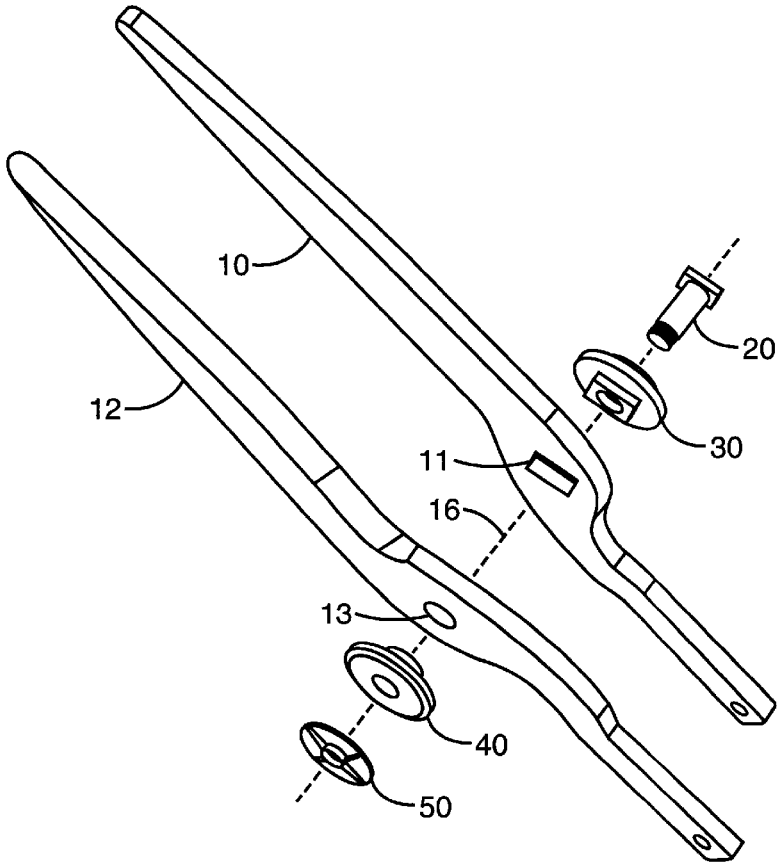
FIG. 1 is an exploded view of a shears with a fastener in accordance with the invention.

FIG. 1 illustrates in exploded view a quick-release, adjustable pivot fastener in accordance with the invention. The invention is advantageous for fastening the elements of pivoting hand tool, and especially for cutting tools, such as a shears, scissors, or snips. For the purposes of the following description, FIG. 1 shows the fastener used with shears cutting blades 10, 12. The fastener attaches the shear blades, referred to herein for convenience as first blade 10 and second blade 12, at the pivot joint 16, indicated by the axis line. As will become understood below, the fastener allows the quick release of the pivot joint for disassembly of the tool parts without the use of a pliers or screwdriver or other tool. In addition, the fastener permits adjustment by hand, also without tools, of the tension on the fastener to adjust the ride of the blades.

Figure 2:
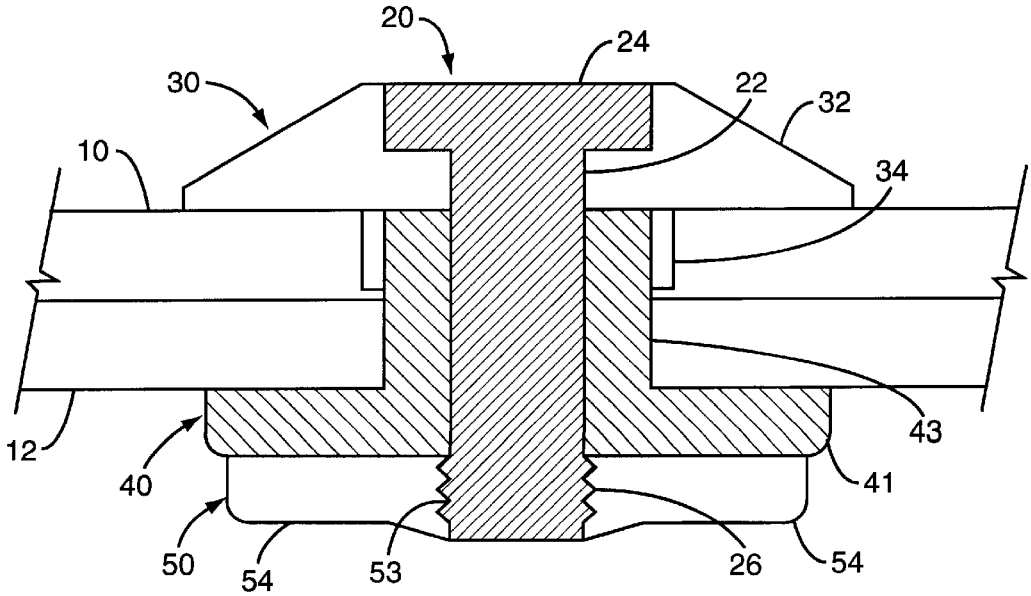
FIG. 2 is an axial section of an assembled fastener.

Referring now also to FIG. 2, which shows a longitudinal section through an assembled fastener, the fastener includes a bolt 20, a first bushing 30, a second bushing 40, and a thumb nut 50. The first bushing 30 is press fit into a mounting hole 11 in the first blade 10, and the second bushing 40 is press fit into a mounting hole 13 in the second blade 12. The bolt 20 is inserted through the first bushing 30 and extends through the second bushing 40. The thumb nut 50 engages the bolt 20 to fasten the components together, completing the assembly.

Figure 3:
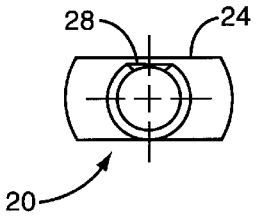
FIG. 3 is a top view of a bolt head for a bolt of the fastener.

The bolt 20 includes a shaft 22 and a head 24. An end portion 26 of the shaft 22 is threaded to mate with the thumb nut 50. FIG. 3 shows the bolt 20 in axial bottom view. For the descriptions of the bolt 20, first bushing 30, second bushing 40, and thumb nut 50, the directions "top" and "bottom" refer to the top and bottom of the assembly shown in FIG. 2, that is, the top view being in the direction from the bolt head 24 toward the thumb nut 50.

The bolt head 24 has an elongated, rectangular shape, which as explained below, cooperates with the first bushing 30 to provide the quick release function of the fastener. The shaft 22 is semi-circular with a flat side 28 that is used to secure the bolt against rotation in the second bushing 40. Preventing rotation of the bolt 20 in the second bushing 40 facilitates tightening the thumb nut 50 on the bolt, and helps avoids unwanted loosening of the bolt 20 and thumb nut 50 when the tool is being used.

Figure 4:
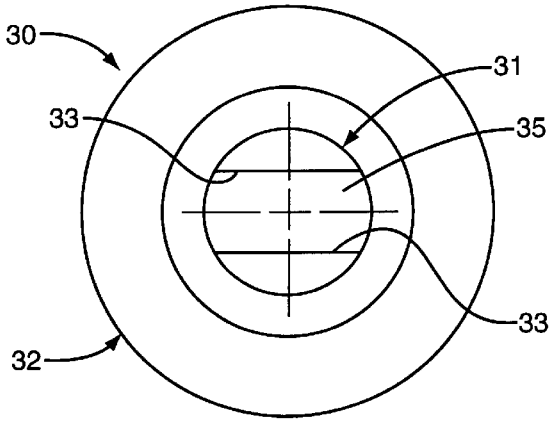
FIG. 4 is a top view of a first bushing of the fastener.

The first bushing 30 includes a cap 32 and a hub 34. The first bushing 30 is illustrated in top view in FIG. 4 and in bottom view in FIG. 5. The cap 32 bears on the first blade to resist axial forces in the fastener. A through hole 31 for the bolt 20 extends axially through the first bushing 30. Shoulders 33 project into the hole 31 in the cap 32 and define bearing surfaces for the bolt head with a slotted opening 35. As can be seen with reference to FIG. 3, the bolt head 24 corresponds in shape to the slotted opening 35, and is given some clearance, which allows the bolt head to pass through the slotted opening 35 when aligned with it.

Figure 5:
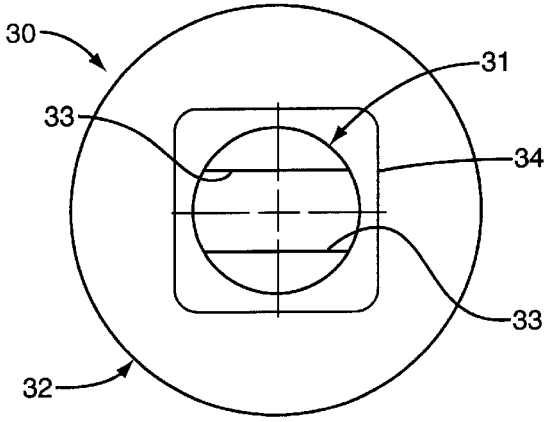
FIG. 5 is a bottom view of the bushing of FIG. 4.

FIG. 5 illustrates the hub 34 in bottom view. The hub 34 is square in cross section to fit into the square mounting hole 11 in the first blade 10, and thus, secure the first bushing 30 against rotation in the blade 10.

Figure 7:
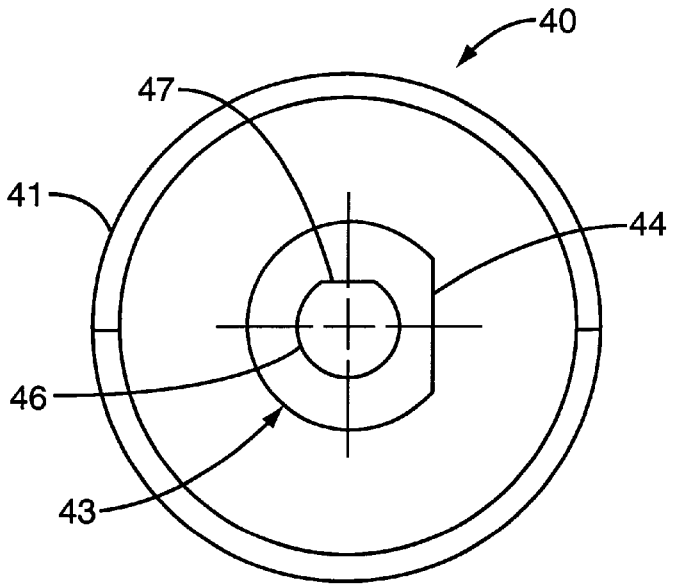
FIG. 7 is a top view of a second bushing of the fastener.
Figure 8:
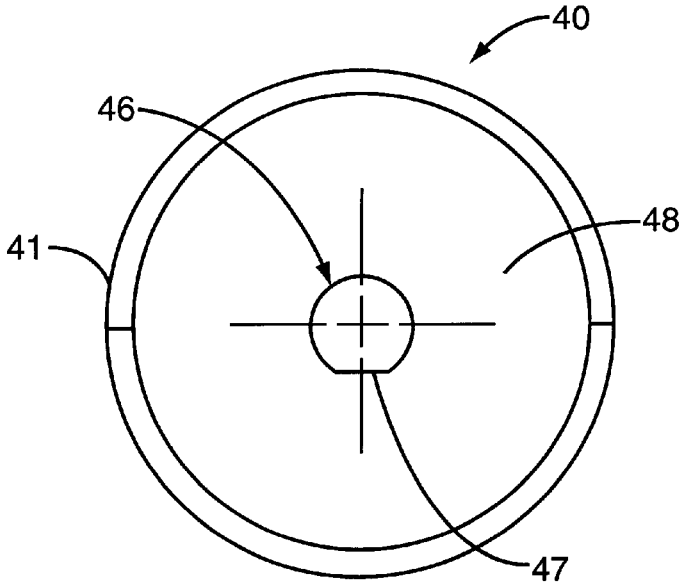
FIG. 8 is a bottom view of the second bushing of FIG. 7.

The second bushing 40 is shown in top view in FIG. 7 and in bottom view in FIG. 8. The second bushing 40 includes a flange 41 that provides a bearing surface on the second blade 12, and a stem 43 that extends axially from the flange. The stem 43 has a semi-circular cross section with a flattened side 44. The mounting hole 13 in the second blade 12 is keyed to accept the stem 43 without allowing relative rotation.

The stem 43 extends into the hub 34 and up to the cap 32 of the first bushing 30, which can be seen in FIG. 2. The mating surfaces of the stem 43 and the hub 34 provide a pivot bearing for the fastener, that is, the stem 43 and the hub 34 pivot relative to one another when the blades 10, 12 are pivoted, and absorb shear forces on the fastener to maintain the tool blades in alignment on the pivot axis 16. The bearing arrangement improves the pivot action during use of the shears by separating the fastening function from the bearing function. In a typical fastener, by comparison, a bolt is used both to fasten the blades and provide the pivot bearing. Such an arrangement is subject to unwanted loosening of the bolt, for example, because the bolt shaft would rub against the pivoting tool elements.

The second bushing 40 includes a through hole 46 for the bolt 20. The through hole 46 is semi-circular with a flat side 47 that mates with the flat side 28 on the bolt shaft 22, which as mentioned above, prevents relative rotation of the bolt 20 and second bushing 40. A bottom surface 48 of the second bushing provides a relatively broad surface for supporting the thumb nut 50 and providing friction to resist loosening.

Figure 6:
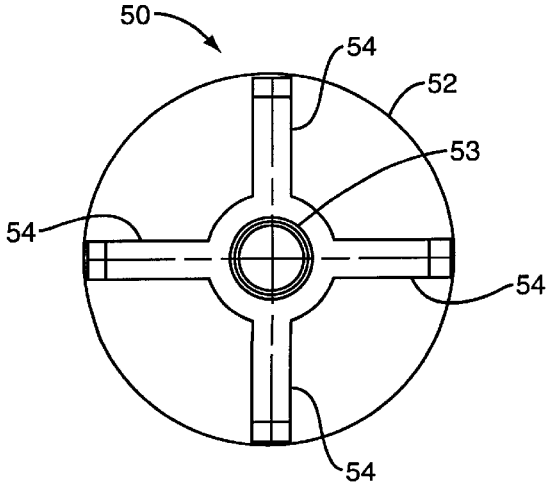
FIG. 6 is a top view of a thumb nut of the fastener.

The thumb nut S0 is shown in bottom view in FIG. 6. The thumb nut 50 includes a disk 52 with a threaded hole 53 that engages the threads on the end portion 26 of the bolt 20. The disk 53 bears on the bottom surface 48 of the second bushing 40. Four wings or ribs 54 project from the disk 52 to provide hand and finger operation of the thumb nut 50.

As described above, the first bushing 30 is press fit into the mounting hole 11 in the first blade 10, and because of the square profile of the hub 34, is secured against rotation in the mounting hole 11. The second bushing 40 is press fit in the mounting hole 13 in the second blade 12, and is keyed to prevent relative rotation therein. The second bushing 40 also extends into the hub 34 of the first bushing 30 to provide a pivot bearing. The bolt 20 is inserted through the holes in the first and second bushings, and is keyed to prevent relative rotation with the second bushing 40.

With the structure according to the invention, pivoting of the blades 10, 12 causes relative pivoting movement in the pivot bearing provided by the first bushing hub 34 and the second bushing stem 43, as described above. The bolt head 24 rests on the shoulders 33 in the first bushing 30, and pivots relative to the shoulders throughout the normal pivoting range of the blades 10, 12. The fixed positions of the first and second bushings relative to the tool blades, and the fixed position of the bolt shaft to the second bushing, establish this relationship.

When the tool blades 10, 12 are pivoted open beyond the normal opening range, the bolt head 24 is aligned with the slotted opening 35 in the first bushing 30, which allows the bolt head 24 to pass through the first bushing 30 and the first blade 10. The blades 10, 12 can thus be easily disassembled for cleaning or sharpening, and just a readily reassembled.

The tension on the bolt 20 and thumb nut 50 can be easily adjusted by hand by turning the thumb nut 50 to adjust the ride of the blades 10, 12. The bolt 20 is secured against rotation in the second bushing 40, which facilitates turning the thumb nut relative to the bolt, and no tools are required to hold the bolt or turn the thumb nut. The large contact area between the thumb nut 50 and the second bushing 40, and the bolt shaft 22 being fixed against rotation in the second bushing 40 help to prevent loosening of the bolt during pivoting movement of the blades 10, 12.

The foregoing has described the principles, features, embodiments and modes of operation of the present invention. The invention, however, should not be construed as limited to the described embodiments, rather, the description is illustrative, and it should be appreciated that the variations, modifications and equivalents may be made by others without departing from the scope of the invention as defined in the following claims.

I claim:

1. An adjustable and releasable fastener for pivoting members of a hand tool, comprising:

a first bushing having a hub and a cap radially extending from an end of the hub, the hub being insertable in a mounting hole in a first tool member with the cap bearing on the first tool member, the hub having an axially directed first hole, the cap having opposing shoulders projecting radially into the first hole to provide bearing surfaces and a slotted opening;

a second bushing having a stem and a flange, the stem being insertable in a mounting hole in a second tool member with the flange bearing on the second tool member, the second bushing having a second hole extending axially through the stem and the flange;

a bolt having a head and a shaft with a threaded end portion, the bolt head contacting the shoulders for a fastening position, the shaft extending through the first and second holes and extending beyond the flange of the second bushing, the bolt head having a shape corresponding to the slotted opening in the cap; and, a nut having a disk with a threaded hole for mating with the threaded end portion of the bolt to adjustably tighten the bolt head against the shoulders, wherein the bolt head has a fastening position engaging the shoulders, and a release position aligned with a slotted opening for withdrawing the bolt head through the first hole to separate the tool members.

2. The fastener as claimed in claim 1, wherein the stem is received in the first bushing hole in the hub to provide a pivot bearing.

3. The fastener as claimed in claim 1, further comprising a plurality of ribs projecting from the disk providing grips for turning the nut to adjust tension on the bolt.

4. The fastener as claimed in claim 1, wherein the stem is shaped to engage the mounting hole in the second tool member to resist rotation and the hub is shaped to engage the mounting hole in the first tool member to resist relative rotation.

5. The fastener as claimed in claim 1, wherein the bolt shaft and the second bushing hole are shaped to engage for resisting relative rotation.

6. An adjustable and releasable fastener for pivoting members of a hand tool, comprising:

a first bushing having a hub and a cap radially extending from an end of the hub, the hub being insertable in a mounting hole in a first tool member with the cap bearing on the first tool member, the hub engaging the mounting hole to resist rotation, the first bushing having an axially directed first hole extending through the hub and cap and having shoulders projecting partially into the first hole;

a second bushing having a stem and a flange, the stem being insertable in a mounting hole in a second tool member with the flange bearing on the second tool member, the stem engaging the mounting hole of the second tool member to resist rotation, the stem being received in the first bushing hole, mating surfaces of the stem and the hub providing a rotation bearing, the second bushing having a second hole extending axially through the stem and the flange;

a bolt having a head and a shaft with a threaded end portion, the bolt being received in the first bushing hole with the bolt head contacting the shoulders and the shaft extending through the second bushing hole beyond the flange; and, a nut having a disk with a threaded hole for mating with the threaded end portion of the bolt to adjustably tighten the bolt head against the shoulders.

7. The fastener according to claim 6, wherein the shoulders in the first bushing define a slotted opening and the bolt head has a shape corresponding to the slotted opening, and wherein the bolt head has a fastened position engaging the shoulders and a release position aligned with a slotted opening for withdrawing the bolt head through the first hole to separate the tool members.

8. The fastener as claimed in claim 6, further comprising a plurality of ribs projecting from the disk providing grips for turning the nut to adjust tension on the bolt.

9. The fastener as claimed in claim 6, wherein the bolt shaft and the second bushing hole are shaped for engagement to resist relative rotation.

10. A hand cutting tool with an adjustable and releasable pivot fastener, comprising:

first and second tool elements, each having a working end with blades, a neck, and a handle end, the tool elements being connected at the necks for relative pivoting movement, the tool elements having an operating range through which the blades are in contact, a first bushing inserted in a mounting hole in the first tool element, the first bushing having a cap bearing on the first tool element and having a through hole with shoulders projecting into the through hole defining a slotted portion of the through hole;

a second bushing inserted in a mounting hole in a second tool element, the second bushing having a flange and having a through hole, a portion of the second bushing being received in the first bushing through hole to form a pivot bearing;

a bolt having a head and a shaft with a threaded end portion, the shaft extending through the first bushing and the second bushing and beyond the flange of the second bushing, the bolt head being received in the cap and contacting the shoulders; and, a nut having a disk with a threaded hole engaged on the threaded end portion of the bolt for adjustably tightening the bolt, the bolt head bearing on the shoulders throughout the operating range, and being alignable with the slotted portion of the through hole when the tool elements are pivoted beyond the operating range to release the tool elements.

11. The tool as claimed in claim 10, wherein the bolt shaft and the second bushing hole are shaped to resist relative rotation.

12. The tool as claimed in claim 10, wherein the first bushing is non-rotatably fixed in the first tool element mounting hole.

13. The tool as claimed in claim 10, wherein the second bushing is non-rotatably fixed in the second tool element mounting hole.

14. A hand tool having a releaseable fastener comprising:

first and second tool elements, each having a working end with blades, a neck, and a handle end, the tool elements being connected at the necks for relative pivoting movement, the tool elements having an operating range through which the blades are in contact, the first element further including an elongated mounting hole having a width and a length, the width being smaller than the length;

a shaft operatively connected to the second element and extending outward therefrom, the shaft having a radially extending head positioned at an end of the shaft at a distance from the second element, the head having a substantially elongated orientation with width and length dimensions each being smaller than the first element mounting hole width and length, the shaft extending through the first element mounting hole such that the head indirectly bears on the first element throughout an operating range, the head width and length being alignable with the first element elongated mounting hole when the tool elements are pivoted beyond the operating range to release the tool elements.

15. The hand tool of claim 14, wherein the shaft extends through an opening in the second element and includes a threaded portion for receiving a nut.

16. The hand tool of claim 14, wherein the first bushing includes a countersunk hole for receiving the shaft head such that a top edge of the shaft head is substantially flush with the first bushing.

17. A device for fastening first and second tool elements, the device comprising:

a first bushing having a hub and a cap, the first bushing further having a first axial hole having an outer section and an inner section being separated by shoulders extending from the cap;

a second bushing having a flange and a stem, the second bushing further having a second axial hole extending therethrough; and a connector extending through the first and second bushings for connecting the first and second tool elements, the connector having a head positioned within the first bushing outer section, and a shaft that extends through the first bushing inner section and the second bushing axial hole.

18. The device of claim 17, wherein the second bushing stem is positioned within the first bushing hub with the second axial hole aligning with the first axial hole.

19. The device of claim 18, wherein the first bushing cap is adapted to bear on the first tool element and the second bushing flange is adapted to bear on the second tool element.

* * * * *